US010880978B2

(12) United States Patent
Klinkowstein et al.

(10) Patent No.: US 10,880,978 B2
(45) Date of Patent: Dec. 29, 2020

(54) BIPOLAR X-RAY MODULE

(71) Applicant: Newton Scientific, Inc., Cambridge, MA (US)

(72) Inventors: Robert E. Klinkowstein, Winchester, MA (US); Ruth E. Shefer, Newton, MA (US)

(73) Assignee: Newton Scientific, Inc., Cambridge, MA (US)

( * ) Notice: Subject to any disclaimer, the term of this patent is extended or adjusted under 35 U.S.C. 154(b) by 837 days.

(21) Appl. No.: 15/441,849

(22) Filed: Feb. 24, 2017

(65) Prior Publication Data

US 2017/0251545 A1 Aug. 31, 2017

Related U.S. Application Data

(60) Provisional application No. 62/300,351, filed on Feb. 26, 2016.

(51) Int. Cl.

| | |
|---|---|
| ***H01J 35/00*** | (2006.01) |
| ***H05G 1/10*** | (2006.01) |
| ***H01J 35/06*** | (2006.01) |
| ***H01J 35/08*** | (2006.01) |
| ***H01J 35/16*** | (2006.01) |
| ***H05G 1/06*** | (2006.01) |
| *H01J 35/18* | (2006.01) |

(52) U.S. Cl.

CPC ..... *H05G 1/10* (2013.01); *H01J 35/06* (2013.01); *H01J 35/08* (2013.01); *H01J 35/16* (2013.01); *H05G 1/06* (2013.01); *H01J 35/116* (2019.05); *H01J 35/186* (2019.05)

(58) Field of Classification Search

CPC .. H01J 35/06; H01J 35/08; H01J 35/16; H01J 35/116; H01J 35/186

See application file for complete search history.

(56) References Cited

U.S. PATENT DOCUMENTS

| | | | | |
|---|---|---|---|---|
| 6,487,272 | B1 * | 11/2002 | Kutsuzawa | H01J 35/08 378/140 |
| 7,885,386 | B2 | 2/2011 | Sundaram | |
| 8,804,910 | B1 | 8/2014 | Wang et al. | |
| 2006/0098779 | A1 | 5/2006 | Turner | |
| 2009/0010393 | A1 * | 1/2009 | Klinkowstein | H05G 1/10 378/140 |
| 2010/0301985 | A1 | 12/2010 | Luo et al. | |

OTHER PUBLICATIONS

Extended European Search Report, International Application No. 17757300.3, dated Oct. 19, 2019, 6 pages.

International Search Report, International Application No. PCT/US2017/019349, dated Jun. 20, 2017, 4 pages.

* cited by examiner

*Primary Examiner* — Dani Fox

(74) *Attorney, Agent, or Firm* — Dickinson Wright PLLC

(57) ABSTRACT

The present application provides a bipolar x-ray tube module. The bipolar x-ray tube module may include a bipolar x-ray tube and at least two voltage multipliers. The voltage multipliers may be positioned such that the voltage gradient of the first voltage multiplier is substantially parallel to the second voltage multiplier in order to provide a compact configuration.

20 Claims, 6 Drawing Sheets

BIPOLAR X-RAY MODULE

RELATED APPLICATIONS

The present patent document claims the benefit of the filing date under 35 U.S.C. § 119(e) of Provisional U.S. Patent Application Ser. No. 62/300,351, filed Feb. 26, 2016, which is hereby incorporated by reference.

TECHNICAL FIELD

The present application relates to systems and methods for providing compact bipolar X-ray sources for use in field portable or hand-held x-ray imaging instruments and analytical instruments, and relates in particular to the design and construction of high voltage x-ray sources for use in field portable or hand-held x-ray instruments.

BACKGROUND

Interest in the measurement of material properties using x-ray techniques has resulted in the development of compact, low power consumption x-ray sources for portable x-ray analytical instruments. Examples of such instruments are the hand-held x-ray fluorescence analyzers currently available from companies such Thermo Fisher Portable Analytical Instruments, Bruker and Olympus. There has also been recent interest in the development of handheld and field portable x-ray imaging devices for security applications. An example of such a device is the Mini-Z handheld backscatter imager currently available from American Science and Engineering. In such conventional systems, however, the voltages of the x-ray sources have been generally limited to 70 kV and below because of the size requirements for the x-ray tube and the high voltage power supply, as well as the associated electrical insulation and radiation shielding requirements.

BRIEF SUMMARY

The present application provides a bipolar x-ray tube module. The bipolar x-ray tube module includes a bipolar x-ray tube and at least two voltage multipliers. The voltage multipliers are positioned such that their voltage gradients are substantially parallel in order to provide a compact configuration.

Further objects, features and advantages of this invention will become readily apparent to persons skilled in the art after a review of the following description, with reference to the drawings and claims that are appended to and form a part of this specification.

DETAILED DESCRIPTION

There are several important applications that require the use of x-ray energies higher than those produced in the current generation of compact x-ray sources suitable for hand-held use. These include the accurate identification and quantification of elements at depths within certain materials, as well as the identification of certain heavy elements (e.g., lead and cadmium), imaging of objects inside sheet metal enclosures (such as car doors or metal lockers), and numerous medical and dental imaging applications. These applications generally require the use of higher voltage sources (e.g., 80 to 200 kV) for x-ray production. Increasing the voltage level of the high voltage, however, generally requires that the length and diameter of the x-ray tube be increased in order to provide sufficient high voltage insulation between the anode and cathode conductors inside the vacuum envelope of the x-ray tube. Increased x-ray tube size therefore, requires an increase in the size of the hand-held x-ray inspection device. Further, providing sufficient electrical insulation between the housing and electrodes at significantly higher voltages also requires larger distances and thicker insulation. The doubling of the voltage level of a 50 kV tube, therefore, requires a substantial increase in size of a hand-held device that includes the higher voltage x-ray tube.

There remains a need, therefore, for a high voltage hand-held x-ray inspection device that is small-scale (uses a miniature x-ray source), yet is capable of operating in the range of approximately up to, for example, 200 kV.

Figure 1:
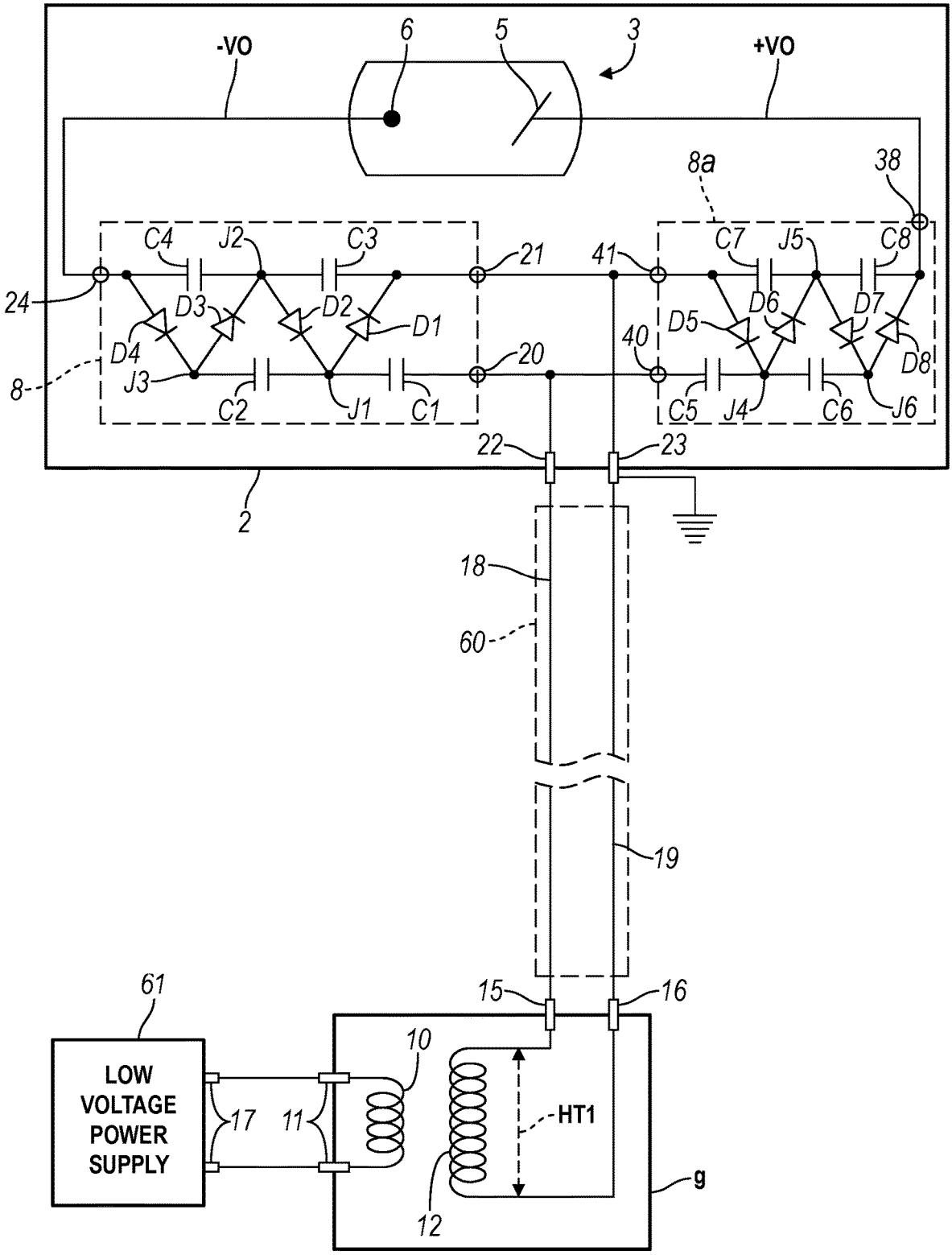
FIG. 1 (prior art)
FIG. 1 is a schematic view of a bipolar x-ray source.

The increase in size of the x-ray source can be significantly reduced by using a bipolar configuration, as illustrated in FIG. 1. In a bipolar x-ray source, a negative high voltage, −Vo, is applied to the cathode end of the x-ray tube and a positive high voltage, +Vo, is applied to the anode end. Electrons accelerated from the cathode reach the anode with an energy of 2 eVo, or twice the energy corresponding to the highest applied voltage Vo in the device. However, the maximum potential difference that must be electrically insulated from the reference ground potential is Vo, and therefore this insulating distance may be the same as in a unipolar configuration with the same Vo. The bipolar power supply configuration is described, for example, in prior art references U.S. Pat. Nos. 4,720,844 and 7,949,099.

The bipolar high voltage power supply comprises two high voltage multiplier sections, one producing a potential +Vo and the other producing a potential −Vo. These multipliers may be configured as shown in FIG. 1, with the ground nodes of each multiplier in close proximity to each other and to the driving step-up transformer, and the high voltage nodes separated by as much distance as possible within the packaging constraints of the power supply. In a miniature x-ray source, the high voltage nodes, at +Vo and −Vo, are connected in turn to the anode and cathode of the miniature x-ray tube. The high voltage power supply and x-ray tube may then be mounted in a conducting housing and encapsulated in a solid electrically insulating material, such as a silicone potting compound, urethane or epoxy. Alternately the housing may be filled with an electrically insulating liquid or gas. Each voltage multiplier section typically comprises a series of interconnected ceramic capacitors and solid state diodes, as is known in the art. The voltage gradient along the length of each multiplier is limited by the sizes of these components to approximately 10 kV/cm or less. The x-ray tube, on the other hand, can support a larger voltage gradient. Metal-ceramic tubes used in present day hand-held x-ray sources typically have overall voltage gradients of 20 kV/cm or higher. In the configuration shown in FIG. 1, the mismatch between the power supply gradient and the x-ray tube gradient means that the gradient along the multiplier section dictates the length of the unit.

If the x-ray source is to be used in a hand-held or portable application, as described above, then minimizing the overall size and weight of the source may be very important. Thus, there is a need for a bipolar power supply and x-ray tube configuration that operates at Vo up to ±100 kV and is consistent with the small dimensions and low weight that may be desirable for portable and hand-held applications.

The implementation described in this application may provide a compact x-ray source for applications in which small size, low weight, and low power consumption.

The implementations described in this application may also provide a compact bipolar power supply module that is capable of operating at voltages up to Vo=±100 kV and power levels≤50 watts for use in hand-held or field-portable x-ray analytical instruments.

Further, the implementations described may provide a miniature x-ray tube and bipolar power supply module for use in hand-held XRF analyzers for the detection of lead in paint, solder, or other industrial materials.

Further, the implementations described may provide a miniature x-ray tube and bipolar power supply module for use in hand-held or field-portable XRF analyzers for the in vivo detection of lead in bone.

In addition, the implementations may provide a miniature x-ray tube and bipolar power supply module for use in hand-held or portable x-ray imaging systems for security, non-destructive testing, dental, veterinary and medical applications.

Figure 2A:
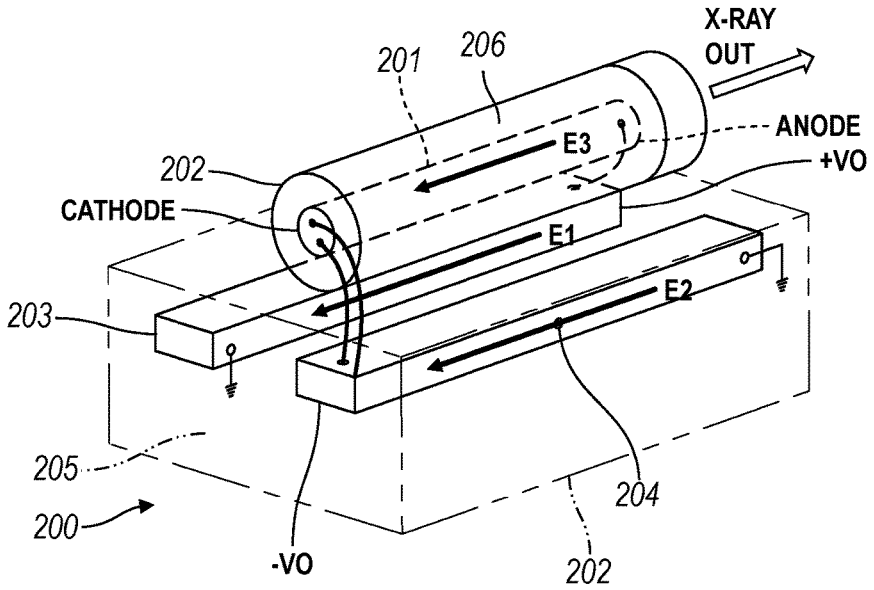
FIGS. 2A and 2B are isometric views of bipolar x-ray sources.
Figure 2B:
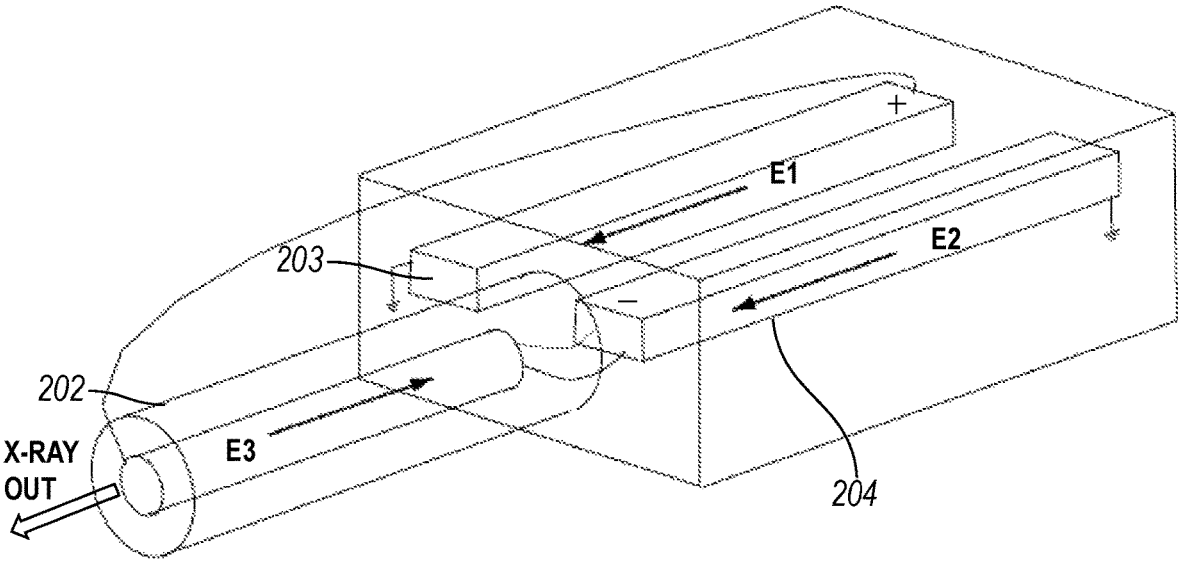

The systems described in the present application may provide a compact configuration for a bipolar x-ray module for use in a portable or handheld x-ray instrument. FIGS. 2A and 2B show examples of the miniature bipolar x-ray module. The bipolar x-ray module 200 comprises a bipolar x-ray tube 201 and a compact bipolar power supply enclosed in a grounded housing 202. The housing 202 may include portions that surround the x-ray tube 201 and voltage multipliers 203, 204, where the portions may be electrically and mechanically connected. In some implementations, the system could be provided in two housings separated by one or more high voltage cables. The bipolar power supply comprises a positive high voltage multiplier 203 and a negative high voltage multiplier 204 plus additional components that are required to power and control the multipliers and x-ray tube. These will be described further below. The regions surrounding the high voltage power supply and x-ray tube are filled with electrically insulating material 205, 206 which may be solid, liquid or gaseous. The electrically insulating material 206 surrounding the x-ray tube may contain radio-opaque material distributed within the electrically insulating material. The high voltage multipliers are configured in a compact geometry such that the voltage gradient along each multiplier is substantially parallel to the voltage gradient along the other multiplier and the resulting average electric fields E1 and E2 of each multiplier point in substantially the same direction. For example, E1 may be within thirty degrees of E2. Configuring the multipliers in this way results in a configuration with low electric field stresses between components and produces a compact design. Furthermore the bipolar x-ray tube 201 may be positioned such that the average electric field E3 between the cathode and anode is oriented substantially parallel to E1 and E2, as shown in FIG. 2A. It should be noted that other orientations of the bipolar x-ray tube are also possible and the module may still benefit from the compact configuration of the multipliers shown in FIG. 2A. For example, E3 may be oriented substantially antiparallel (e.g. parallel but in the opposite direction) to E1 and E2 as shown in FIG. 2B. For example, E3 may be within thirty degrees of both E1 and E2.

Figure 3:
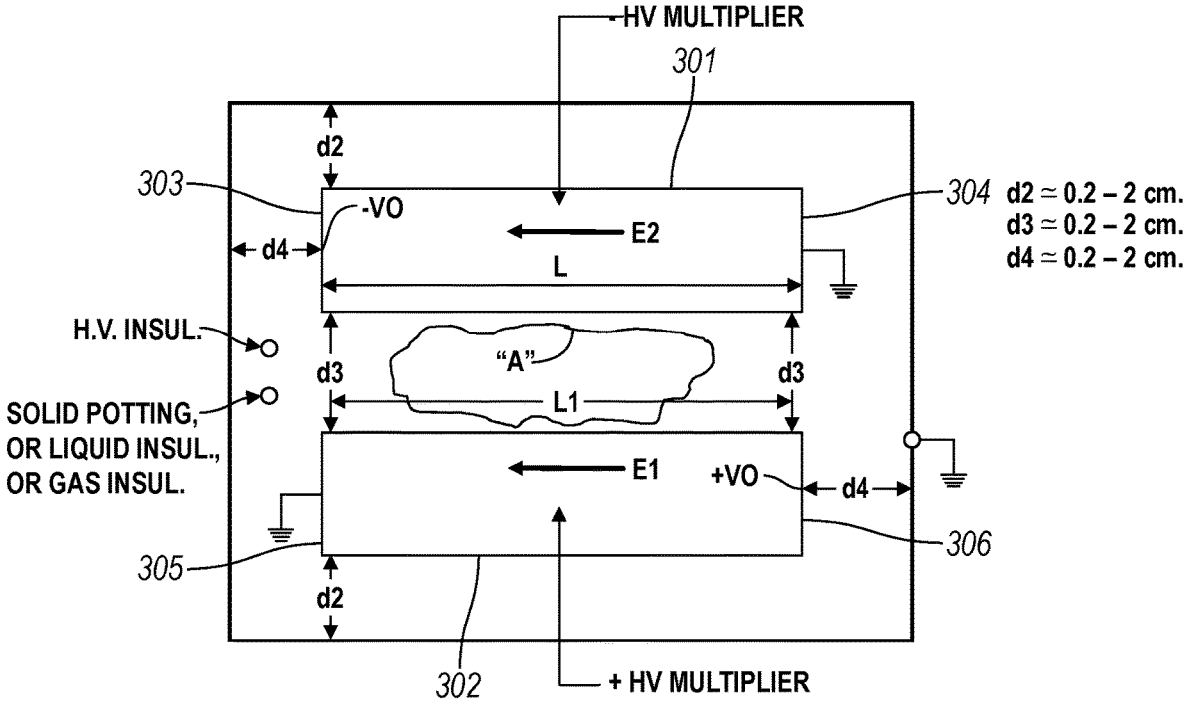
FIG. 3 is block diagram illustrating one implementation of a voltage multiplier assembly.

FIG. 3 shows one implementation of the x-ray instrument in which the high voltage end of each multiplier of length L may be proximate to the grounded end of the other multiplier. The voltage gradient of each multiplier may be defined as the vector derivative of the voltage with distance between the grounded terminal and the high voltage terminal of the multiplier. Hence, the average voltage gradient is the change in voltage along a line between the two terminals of the multiplier divided by the distance between the terminals. By convention, the direction of the average voltage gradient always points towards higher positive voltage. In FIG. 3, the negative voltage multiplier 301 and the positive voltage multiplier 302 are of approximately equal length and are configured such that their voltage gradients are approximately parallel to each other. The overlap distance L1 can be equal to L, as shown in FIG. 3, or can be smaller than L. Typically, L1 may be in the range L≥L1≥0.4 L. This means that the multipliers are aligned with each other so that the negative high voltage terminal 303 of the negative multiplier 301 may be proximate to the ground terminal 305 of the positive multiplier 302 and the positive high voltage terminal 306 of positive multiplier 302 may be proximate to the ground terminal 304 of the negative multiplier 301. The ground terminals 304 and 305 are the low voltage ends of the voltage multiplier assemblies having a smaller potential difference referenced to the case potential than the high voltage terminals 303 and 306. The ground terminals 304, 305 may be directly connected to the case, as indicated in FIG. 3, or may be connected via additional electrical components as may be necessary to facilitate current or voltage monitoring of the multipliers or to provide electrical isolation from the case. The configuration of FIG. 3 creates a desirable situation in which the high voltage terminals of the two multipliers are well separated from each other and the peak electric field in the region "A" between the multipliers may be approximately uniform and may be minimized compared with configurations with L1<L. Furthermore, a compact configuration for the entire module may be achieved since the overall length of the x-ray tube can be made approximately equal to L, as illustrated in FIG. 2. Distances d2 and d4 are standoff distances between a terminal of a voltage multiplier and the grounded housing for the voltages described. For example, d2 and d4 may be a minimum of 0.2-2.0 cm for Vo in the range +/−35 kV to ±100 kV. Similarly, d3 is the standoff distance between the high voltage end of one multiplier and the low voltage end of the other multiplier. The minimum value of d3 is similar to that of d2 and d4 for the same range of values of Vo.

Figure 4:
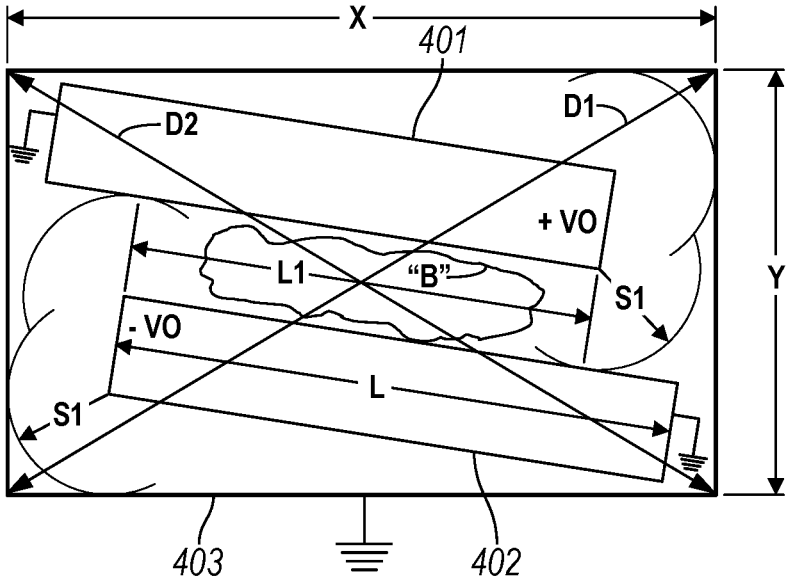
FIG. 4 is block diagram illustrating another implementation of a voltage multiplier assembly.

FIG. 4 shows another implementation of the x-ray instrument in which the positive high voltage multiplier 401 and the negative high voltage multiplier 402 are both of length L. The terminals of the positive high voltage multiplier 401 and the terminals of the negative high voltage multiplier 402 may be positioned diagonally or substantially along a diagonal in a rectangular grounded housing 403. The multipliers may be approximately parallel to each other, and the high voltage end of each of the two multipliers may be positioned near opposite ends of a diagonal, D1, within the rectangular box. The grounded end of each multiplier may be positioned near opposite ends of a diagonal D2. In this implementation, the positive terminal may be located proximate the ground terminal of the negative voltage multiplier and the negative terminal may be located proximate the ground terminal of the positive voltage multiplier. As such, the positive terminal may be located closer the ground terminal of the negative voltage multiplier than the negative terminal and the negative terminal may be located closer to the ground terminal of the positive voltage multiplier than the positive terminal. For example in the voltage ranges discussed, the positive terminal may be located less than two centimeters from the ground terminal of the negative voltage multiplier and the negative terminal may be located less than two centimeters from the ground terminal of the positive voltage multiplier.

The high voltage ends of the multipliers may also be positioned with a standoff distance, S1, which is sufficient to provide high voltage insulation between the grounded case and the end of the high voltage multiplier. The minimum distance between the multipliers is governed by the peak electric field in region "B" in FIG. 4. It should be noted that the overlap distance L1<L in FIG. 4 and therefore the peak electric field in region "B" may be larger than the peak electric field in a configuration in which L1=L. However, by placing the terminals of the multipliers approximately along the diagonal of a rectangular housing, a very compact configuration can be achieved.

Typical design parameters for a compact bipolar power supply of the design shown in FIG. 4 are as follows:

+35 kV<+Vo<+100 kV

−35 kV>−Vo>−100 kV 2.5 cm<X<18 cm 2.5 cm<Y<18 cm 0.2 cm<S1<2.5 cm 3.8 cm<D1, D2<31 cm

Figure 5:
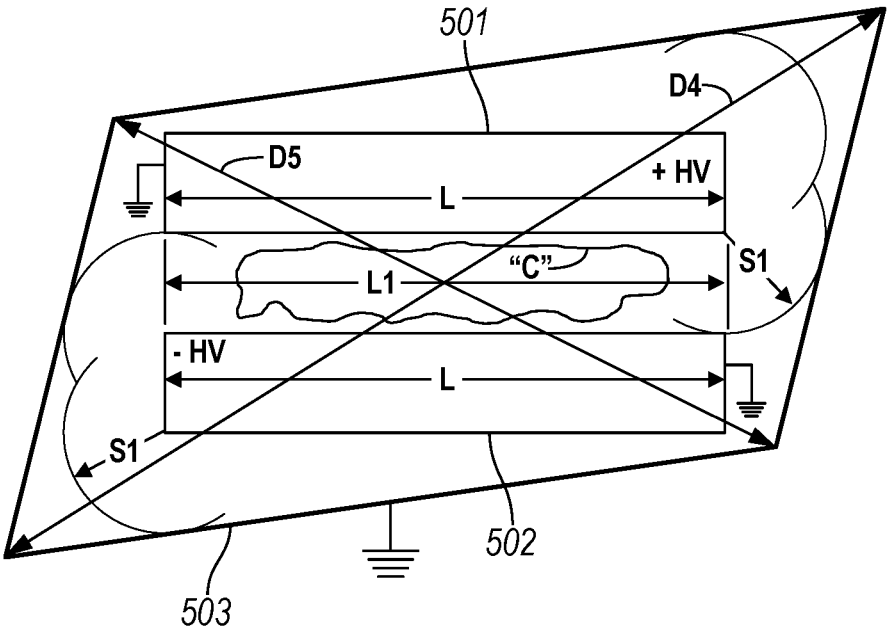
FIG. 5 is block diagram illustrating another implementation of a voltage multiplier assembly.

Another implementation of a compact power supply design is shown in FIG. 5. In this example two high voltage multipliers, 501 and 502, of length L may be positioned within a grounded housing 503 that is in the shape of a parallelogram or trapezoid. The high voltage end of each multiplier may be positioned along roughly a diagonal D4 that is longer than the diagonal, D5, which roughly extends between the grounded ends of the two multipliers. This positioning allows the ends of the multipliers to be aligned with overlap distance L1=L and creates a region "C" between the two multipliers that is has a substantially uniform and minimized electric field.

The design approaches described above provide very compact, reliable bipolar modular designs with a low probability of failure due to arcing. These compact designs are especially well suited for handheld, battery powered, portable applications, because of their small size and low weight. By orienting the high voltage output of each multiplier approximately along one diagonal, and the grounded ends of the multipliers along the other diagonal, a compact reliable design can be achieved. It should be recognized that it is not a requirement of the compact bipolar design that both high voltage multipliers have the same high voltage magnitude or overall length. For example, +Vo could be equal to +80 kV and −Vo could be equal to −40 kV and many of the advantages of the compact bipolar power supply designs described above can still be realized.

In general, the bipolar x-ray tube may be positioned with the cathode proximate to the negative terminal 303 of the negative high voltage multiplier 301 and the anode proximate to the positive terminal 306 of the positive high voltage multiplier 302. As such, the cathode may be positioned closer to the negative terminal 303 than the positive terminal 306; and the anode may be positioned closer to the positive terminal 306 than the negative terminal 303. For example in the voltage ranges given, the cathode may be positioned within 7 centimeters of the negative terminal 303 of the negative high voltage multiplier 301 and the anode may be positioned within 7 centimeters of the positive terminal 306 of the positive high voltage multiplier 302. For a compact design, the x-ray tube may be positioned approximately along D1 in FIG. 4 or D4 in FIG. 5. However, the positioning of the x-ray tube approximately along a diagonal is not required. For convenience, the x-ray tube may be located parallel to the edges of the housing allowing easy alignment.

Figure 6:
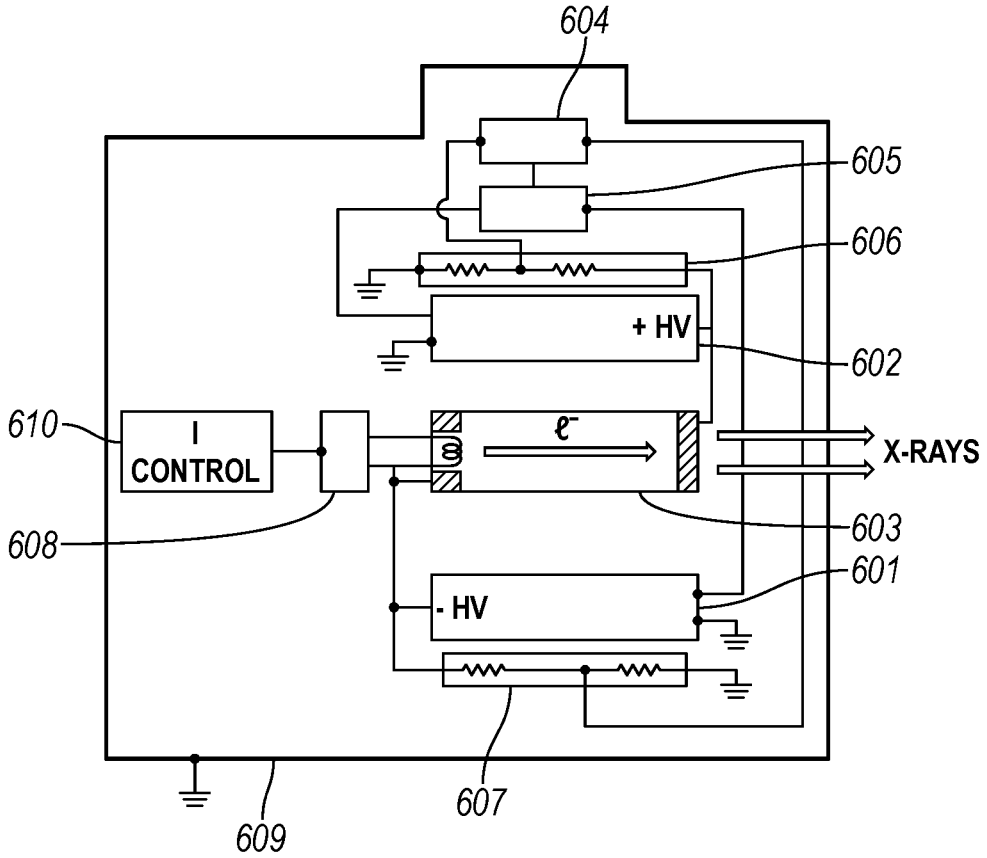
FIG. 6 is an electrical schematic of a bipolar x-ray module.

FIG. 6 is an electrical schematic of the bipolar x-ray module showing the high voltage multipliers 601 and 602, and the x-ray tube 603. The electrical connections illustrated in FIG. 6 may apply to the voltage multiplier configurations described in any of the other Figures. In FIG. 6, both high voltage multipliers are connected to an AC power source 604 via a step-up transformer 605. The AC power source 604 may also include control circuitry for controlling the voltage and current provided to the x-ray tube. High voltage is monitored using voltage dividers 606 and 607 connected to each multiplier respectively. It should be noted that a single voltage divider connected to one multiplier can also be used. It should also be noted that instead of driving both multipliers with a single step-up transformer 605, each multiplier could be driven with a separate step-up transformer with a single AC power source, or each with its own AC power source. The output of the positive high voltage multiplier may be connected to the anode terminal of the x-ray tube and the output of the negative voltage multiplier may be connected to the cathode terminal of the x-ray tube. Electrical power may be supplied to the cathode of the x-ray tube using, for example, an isolation transformer 608 and power source 610. The high voltage portion of the power supply is surrounded by a conductive housing 609 held at a reference (ground) potential.

Figure 7:
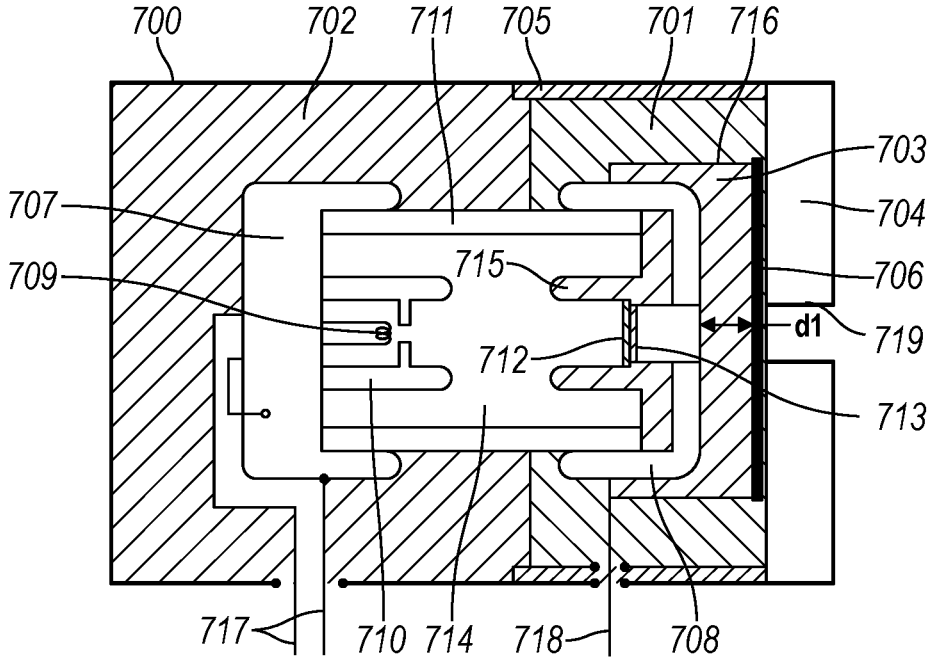
FIG. 7 is a cross section of a compact bipolar x-ray tube module.

FIG. 7 shows one example of a cross section of a portion of a compact bipolar module that contains the miniature bipolar x-ray tube. The elements in FIG. 7 may generally correspond to 201, 202, and 206 in FIG. 2. The x-ray tube comprises a cathode end 707 which may be electrically connected to the negative high voltage terminal of the bipolar power supply with cathode leads 717, and an anode end 708 which may be electrically connected to the positive high voltage terminal with anode lead 718. The cathode end may contain an electron emitter 709 and one or more beam shaping electrodes 710 to focus the electron beam onto the target at the anode end. The electron emitter may be a tungsten filament emitter or any other electron emitter known in the art. The cathode end and anode end are separated by a hollow electrical insulator 711 that forms a portion of the vacuum envelope of the x-ray tube. The insulator may be a tube made from aluminum oxide, beryllium oxide, glass, or any other vacuum-compatible high voltage insulating material known in the art. The region 714 defined by the interior of the hollow insulator and the cathode and anode ends is maintained at a vacuum sufficient to allow electrons to flow substantially unimpeded between the cathode and anode. During operation of the x-ray tube, electrons are accelerated between the cathode and anode in the electric field produced by the cathode to anode voltage difference.

The anode end of the x-ray tube comprises an x-ray producing target 712 and an x-ray transmissive window 713 that forms one end of the vacuum envelope of the x-ray tube. The anode may also include a cylindrical electrode 715, or anode hood, a purpose of which is to prevent electrons scattered in the backwards direction from the target from impinging on the insulator. The x-ray transmissive window may be formed from beryllium, beryllium oxide, titanium, or any other vacuum compatible material with sufficient mechanical strength to hold a pressure difference of at least one atmosphere and high x-ray transmissivity in the energy range of interest. The x-ray producing target is held at anode potential and may be placed anywhere in the path of the electron beam. In order to maximize the flux from the x-ray tube it may be advantageous to place the target as close as possible to the output window. The x-ray target may be applied directly to the vacuum side of the beryllium window. The thickness of the x-ray target is chosen so as to be thick enough to cause the electrons to slow down and produce x-rays and thin enough to allow the x-ray flux to escape in the forward direction through the Be window. For example, for a 120 kV cathode to anode voltage difference, the x-ray target may be a layer of gold, tungsten, or other suitable material of thickness between 2 μm-20 μm deposited directly onto the vacuum side of the Be window. It should be noted that the bipolar x-ray tube could also be configured in a side-window design using a solid reflection target and x-ray transmissive window, as is known in the art.

The compact bipolar x-ray tube and power supply may be enclosed in a conductive housing 700 held at a reference (ground) potential. The conductive housing forms an equipotential surface around the x-ray tube and power supply. Since the cathode and anode ends of the x-ray tube are at high voltage relative to the housing, the region around the entire x-ray tube may be filled with electrically insulating materials 701, 702 designed to prevent high voltage breakdown from occurring between the tube electrodes and the adjacent housing. The electrically insulating material may be a solid encapsulating material, also known as a potting material (e.g. silicone, silicone gel, urethane, epoxy, and others), a liquid (e.g. transformer oil, Fluorinert, or other fluorocarbon-based liquids), or a pressurized gas (e.g. sulfur hexafluoride, dry nitrogen, and others). Solid encapsulating material such as silicone may be preferred because it is mechanically stable. In addition, solid encapsulating material may be loaded with a radio-opaque filler in order to provide enhanced x-ray shielding in the vicinity of the x-ray tube, as described in U.S. Pat. Nos. 7,949,099, 7,448,801, and 7,448,802. Examples of such radio-opaque fillers are oxides of bismuth or tungsten, but many other high atomic number elements or their compounds may also be used. The radio-opaque filler need not be uniformly distributed in the encapsulating material; in some cases it is advantageous to create regions with different concentrations of filler as will be described below.

In contrast to other regions surrounding the x-ray tube where it is desirable to block the x-ray flux, the region 703 adjacent to the x-ray output window may be preferably filled with an electrically insulating material that is relatively transparent to x-rays. It may also be advantageous for the insulator adjacent to the anode/x-ray window to have good high temperature properties. Amorphous thermoplastic polyetherimide (PEI) resins, such as Ultem, may be used for the insulator. The thickness d1 of the insulator 703 is governed by the dielectric properties of the electrically insulating material, and is typically 1-10 mm. The insulator 703 may be shaped such that the distance d1 between the output window of the x-ray tube and the output aperture 719 in the grounded housing is minimized in order to maximize x-ray transmission. At the same time, it may be desirable to maximize the path length along the boundary between the transparent insulator and the encapsulating material in order to minimize electric field stress along this boundary and reduce the probability of high voltage breakdown. Therefore, it may be advantageous to extend the transparent insulator in the direction transverse to the shortest distance d1 between the x-ray window and the grounded housing. An example of this geometry is shown in FIG. 7 in which the boundary 716 between the transparent insulator and the encapsulating material 701 is made longer in order to minimize the electric field strength along the interface. A plate 704 with an aperture 719 may be placed in front of the transparent insulator to define the effective emission aperture of the bipolar x-ray tube. The plate 704 may be made of a suitable thickness of tungsten or other x-ray absorbing materials. The surface of the insulator 703 within the aperture 719 may be covered with a thin conducting layer 706. The conducting layer 706 may be electrically connected to plate 704 and may reduce the electrical field in the corners of the aperture 719.

It is apparent that by extending the transparent insulator away from the axis of the x-ray tube, the thickness of encapsulating material containing radio-opaque filler may be reduced in the region 701 surrounding the x-ray target and anode of the x-ray tube, as compared with region 702. Region 702 may surround the cathode end of the x-ray tube. Region 701 and 702 may have an equal concentration of radio-opaque filler. In some implementations, it may be advantageous to use a higher concentration of radio-opaque filler in region 701 as compared with region 702. For example, the radio-opaque filler concentration could be increased by a factor of 10 or more in region 701 to compensate for the reduced thickness of encapsulating material. In some implementations, regions 701 and 702 may be excluded, such that, the grounded housing alone provides x-ray shielding. Typical formulations for the mixture of radio-opaque filler and the encapsulating material include bismuth oxide powders mixed with silicones (RTVs) or epoxies. Typical mixture ratios are from 0.4 grams of bismuth oxide powder per 1 gram of silicone or epoxy resin, up to 10 grams of bismuth oxide powder per 1 gram of silicone or epoxy resin. Bismuth oxide is commonly supplied in powder form and can also be referred to as bismuth (III) oxide or bismuth trioxide.

It should be recognized that regions 701 and 702 need not be distinct regions with different concentrations of radio-opaque filler. Instead the density of radio-opaque filler could be increased continuously between the two regions, resulting in a gradient in the concentration of radio-opaque filler with the highest concentration surrounding the tube anode and transparent insulator. In addition, to further increase the amount of radiation shielding a thin sleeve 705 of radio-opaque material such as tungsten or lead can be added at the grounded housing in the region close to the x-ray tube anode.

Figure 8:
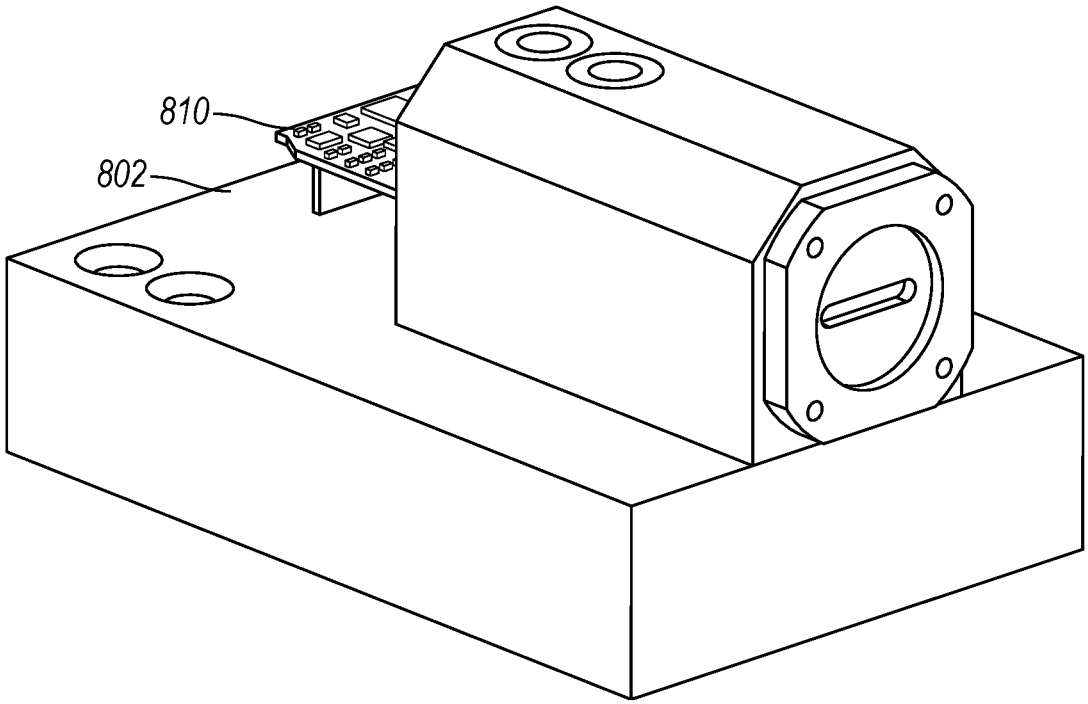
FIG. 8 is a line rendering of a prototype of the bipolar x-ray tube module.

A line rendering of a prototype compact bipolar x-ray module of the type described above is shown in FIG. 8. This module has a maximum Vo=±60 kV resulting in a total cathode to anode voltage difference of 120 kV, and a maximum power of 10 watts. The housing 802 is grounded and has portions enclosing the x-ray tube and the voltage multipliers. An electronic assembly 810 is mounted external to the housing and may include power sources (e.g. 604 and 610 from FIG. 6).

As a person skilled in the art will readily appreciate, the above description is meant as an illustration of the principles of this invention. This description is not intended to limit the scope or application of this invention in that the invention is susceptible to modification, variation and change, without departing from spirit of this invention, as defined in the following claims.

The invention claimed is:

1. Bipolar x-ray tube module comprising:

a bipolar x-ray tube having an anode and a cathode;

a positive voltage multiplier having a positive terminal and a ground terminal, the positive voltage multiplier producing a first voltage gradient; and a negative voltage multiplier having a negative terminal and a ground terminal, the negative voltage multiplier producing a second voltage gradient, wherein the first voltage gradient is substantially parallel to the second voltage gradient, the positive terminal being located more proximate to the ground terminal of the negative voltage multiplier than to the negative terminal, the negative terminal being located more proximate to the ground terminal of the positive voltage multiplier than to the positive terminal.

2. The bipolar x-ray tube module of claim 1 wherein the cathode is located proximate to the negative terminal of the negative voltage multiplier and the anode is located proximate to the positive terminal of the positive voltage multiplier.

3. The bipolar x-ray tube module of claim 1, further comprising x-ray shielding, wherein the x-ray shielding is substantially provided by radio-opaque filled potting surrounding the x-ray tube, the radio-opaque filled potting having one or more regions with specified radio-opaque filler concentrations.

4. The bipolar x-ray tube module of claim 3, wherein the concentration of radio-opaque filler is higher surrounding the anode of the x-ray tube than surrounding the cathode of the x-ray tube.

5. The bipolar x-ray tube module of claim 1, wherein the x-ray tube anode comprises an x-ray transmissive window with a target material applied directly to the x-ray transmissive window, the target material having a thickness in the range 2 μm-20 μm.

6. The bipolar x-ray tube module of claim 1, further comprising a grounded housing that encloses the positive voltage multiplier and the negative voltage multiplier.

7. The bipolar x-ray tube module of claim 6, wherein the positive voltage multiplier and negative voltage multiplier have an overlap distance, the overlap distance being greater than 0.4 times the length of at least one of the multipliers.

8. The bipolar x-ray tube module of claim 6, wherein the x-ray tube is also enclosed in the grounded housing.

9. The bipolar x-ray tube module of claim 6 wherein the x-ray tube is electrically connected to the multipliers using one or more high voltage cables.

10. The bipolar x-ray tube module of claim 6, wherein the grounded housing is a rectangular grounded housing.

11. The bipolar x-ray tube module of claim 10, the positive voltage multiplier and the negative voltage multiplier are both approximately parallel to each other, the positive terminal and the negative terminal being positioned near opposite ends of a first diagonal within a rectangular grounded housing.

12. The bipolar x-ray tube module of claim 11, wherein the grounded end of the positive voltage multiplier and the grounded end of the negative voltage multiplier are positioned near opposite ends of a second diagonal of the rectangular grounded housing.

13. The bipolar x-ray tube module of claim 6, wherein the positive voltage multiplier operates in the range of +35 kV to +100 kV and the negative voltage multiplier operates in the range of −35 kV to −100 kV.

14. The bipolar x-ray tube module of claim 13, wherein the positive terminal and the negative terminal are located between 0.2 and 2.5 cm from the grounded housing.

15. The bipolar x-ray tube module of claim 1, wherein the bipolar x-ray tube module is configured for use in a handheld or portable instrument.

16. A bipolar x-ray tube module comprising:

a bipolar x-ray tube having a first voltage gradient;

a first voltage multiplier having a second voltage gradient generating a first average electric field;

a second voltage multiplier having a third voltage gradient generating a second average electric field, wherein the second and third voltage gradients are substantially parallel to each other and the first and second average electric fields point substantially in the same direction; and a grounded housing that encloses the bipolar x-ray tube, the first voltage multiplier and the second voltage multiplier.

17. The bipolar x-ray tube module of claim 16, wherein the first voltage gradient is substantially parallel to the second and third voltage gradients.

18. The bipolar x-ray tube module of claim 16, wherein the first voltage gradient is substantially antiparallel to the second and third voltage gradients.

19. The bipolar x-ray tube module of claim 16, wherein a high voltage end of the first voltage multiplier is located proximate to a ground end of the second voltage multiplier and the high voltage end of the second voltage multiplier is located proximate to the ground end of the first voltage multiplier.

20. The bipolar x-ray tube module of claim 16, the high voltage end of each of the first and second voltage multipliers are positioned near the opposite ends of a first diagonal within a rectangular grounded housing, the grounded end of the first voltage multiplier and the grounded end of the second being positioned near the opposite ends of a second diagonal of the rectangular grounded housing.

* * * * *